US006263513B1

(12) United States Patent
Murakami

(10) Patent No.: US 6,263,513 B1
(45) Date of Patent: Jul. 24, 2001

(54) HELMET WITH A VENTILATING FUNCTION AND VENTILATING SHUTTER DEVICE

(75) Inventor: Takeshi Murakami, Higashi-Osaka (JP)

(73) Assignee: O.G.K. Hanbai Co., Ltd., Osaka (JP)

( * ) Notice: Subject to any disclaimer, the term of this patent is extended or adjusted under 35 U.S.C. 154(b) by 0 days.

(21) Appl. No.: 09/451,102

(22) Filed: Nov. 30, 1999

(30) Foreign Application Priority Data

May 25, 1999 (JP) ..... 11-145334

(51) Int. Cl.[7] ..... A42B 3/28
(52) U.S. Cl. ..... 2/171.3; 2/422; 2/424
(58) Field of Search ..... 2/410, 411, 422, 2/424, 425, 171.3, 6.1, 6.2, 6.3, 6.4, 6.5

(56) References Cited

U.S. PATENT DOCUMENTS

| | | | | |
|---|---|---|---|---|
| 3,496,854 | * | 2/1970 | Feldmann et al. | 2/410 |
| 4,586,197 | | 5/1986 | Hubbard . | |
| 5,361,419 | * | 11/1994 | Bernstein | 2/423 |
| 5,937,446 | * | 8/1999 | Fallert | 2/412 |
| 5,996,128 | * | 12/1999 | Yanagihara | 2/422 |

FOREIGN PATENT DOCUMENTS

| | | |
|---|---|---|
| 2198925A | 6/1988 | (GB) . |
| 1-136140 | 9/1989 | (JP) . |
| 1-29209 | 9/1989 | (JP) . |
| 3-70229 | 7/1991 | (JP) . |
| 6-40566 | 10/1994 | (JP) . |
| 10-53915 | 2/1998 | (JP) . |
| 1053915 | 2/1998 | (JP) . |
| 3050720 | 5/1998 | (JP) . |

* cited by examiner

*Primary Examiner*—Michael A. Neas
(74) *Attorney, Agent, or Firm*—Birsch, Stewart, Kolasch & Birch, LLP

(57) ABSTRACT

A helmet with a ventilating function is provided, including: a helmet shell having on an outer surface thereof a longitudinally extending outside air path configured to introduce outside air thereinto from a front air inlet thereof and discharge the same rearwardly from a rear air outlet thereof to form an outside air flow that sucks inside air remaining in the helmet shell by its negative pressure to achieve ventilation; a path defining body defining the outside air path; and a rear deflector for facilitating release of an air flow from a rear portion of the outer surface of the helmet shell, the path defining body and the rear deflector being unified in configuration.

18 Claims, 15 Drawing Sheets

HELMET WITH A VENTILATING FUNCTION AND VENTILATING SHUTTER DEVICE

BACKGROUND OF THE INVENTION

1. Field of the Invention

The present invention relates to a helmet with a ventilating function, and a ventilating shutter device applicable to this helmet.

2. Description of the Related Art

When a helmet put on a rider of a motorcycle or the like receives a high wind pressure from the front in, for example, a high speed traveling, a wind passing around the helmet causes a negative pressure (turbulence) to occur at a lower rear portion of the helmet shell, which often leads to a phenomenon that draws the helmet rearward. This phenomenon imposes a great burden on the muscles of the neck of the rider.

To inhibit this phenomenon, there has been proposed a rear deflector (rearwardly-oriented visor) attached to a rear portion of a helmet (refer to U.S. Pat. No. 4,586,197). This rear deflector is secured to a rim of a lower rear portion of the helmet and extending upwardly and rearwardly to cover the lower rear portion of the helmet. The rear deflector allows the neck muscles of the helmet wearer to be most relaxed (mitigating the burden on the neck muscles) at each speed in a motorcycle traveling in which the wearer's head is inclined forwardly or rearwardly.

A helmet with a ventilating function is known which is provided with an outside air path on the outer periphery of the helmet for allowing outside air to be taken therein from the front and to be discharged rearward (refer to, for example, Japanese Examined Utility Model Publication No. HEI 1-29209). The outside air flow passing through the outside air path causes a negative pressure that sucks inside air remaining within the helmet, thereby achieving ventilation. The helmet with a ventilation function described in this publication is formed with an air outlet in a lower rear portion of the helmet shell which is in the form of a rearwardly protruding square pipe.

Though this helmet is not capable of regulating the air flow rate, there is known a helmet provided with a shutter device in, for example, an upper front portion of the helmet shell for achieving air flow regulation.

If an attempt is made to attach the conventional rear deflector to the aforementioned helmet with a ventilating function, the rear deflector is likely to interfere with the air outlet because of their overlapped location and, hence, the attempt may fail. In addition, because such a conventional helmet has the air outlet protruding from the lower rear portion of the helmet shell and does not have the rear deflector, turbulence is likely to be caused by an outside air flow along an outer surface of the helmet shell and an outgoing air flow from the air outlet. Such turbulence will work as an air resistance to the helmet.

As described above, there is known a helmet with both a ventilating function and a shutter device for regulating the air flow rate. Such a shutter device is often made small so as to avoid conspicuousness in outward appearance, resulting in a limited amount of air to be taken in the air path.

If a plurality of such shutter devices were provided on the helmet shell to increase the intake air amount, troublesome and costly assembling and mounting of each shutter device would become necessary in addition to cumbersome individual operations for these shutter devices.

In view of the foregoing, it is a first object of the present invention to provide a helmet having a ventilating function and a deflecting function that do not interfere with each other and that provide a unified appearance to avoid mar of the outward appearance of the helmet as a whole.

It is a second object of the present invention to provide a helmet having a ventilating function and a deflecting function that do not interfere with each other, while allowing a rearward outgoing air flow caused by the ventilating function to be smoothly released from the helmet shell thereby preventing the occurrence of air resistance attributable to the ventilating function.

It is a third object of the present invention to provide a helmet that effectively utilizes a rearward outgoing air flow caused by the ventilating function to enhance the deflecting function of a rear deflector, thereby enhancing the fitting stability of the helmet on a rider of a running motorcycle or bicycle.

It is a fourth object of the present invention to provide a ventilating shutter device that is applicable to a helmet having a ventilating function and a rear deflector, and that does not mar the overall outward appearance of the helmet.

It is a fifth object of the present invention to provide a ventilating shutter device that is applicable to a helmet with a ventilating function, that ensures a sufficient amount of intake outside air for ventilation without marring the outward appearance of the helmet, and that can be assembled, mounted and operated easily.

SUMMARY OF THE INVENTION

According to one aspect of the present invention, there is provided a helmet with a ventilating function, comprising: a helmet shell having on an outer surface thereof a longitudinally extending outside air path configured to introduce outside air thereinto from a front air inlet thereof and discharge the same rearwardly from a rear air outlet thereof to form an outside air flow that sucks inside air remaining in the helmet shell by its negative pressure to achieve ventilation; a path defining body defining the outside air path; and a rear deflector for facilitating release of an air flow from a rear portion of the outer surface of the helmet shell, the path defining body and the rear deflector being unified in configuration.

With this construction, the helmet enjoys both the ventilating function and the deflecting function at the rear portion thereof and exhibits an improved and unified outward appearance, thereby attaining the first object of the present invention.

Preferably, the air outlet of the outside air path is oriented along a line tangential to the helmet shell that forms an angle of use relative to an axis of the helmet shell in use (the angle at which a helmet wearer rides a motorcycle or the like).

This feature allows an outgoing air flow from the rear air outlet to be smoothly released from the helmet shell with less likelihood of causing turbulence, resulting in a decreased air resistance. Thus, the second object of the present invention is attained.

It is recommended that the rear deflector be located immediately behind the air outlet. With this feature, an outgoing air flow from the air outlet (mixture of outside air and inside air) is deflected by the rear deflector to facilitate release of this air flow from the helmet shell, with the result that an air resistance is unlikely to be caused. In addition, since the outgoing air flow from the air outlet is led to the rear deflector, the deflecting action of the rear deflector can be fully utilized. Thus, this arrangement not only prevents an air resistance attributable to the provision of the ventilating function but also enhances the air deflecting action of the rear deflector, thereby improving the fitting stability of the helmet on the rider of a running motorcycle or the like. Hence, the aforementioned second and third objects of the invention are attained.

The path defining body may define a plurality of outside air paths parting on at least the right and left sides of the helmet shell. In this case, the rear deflector comprises a first deflecting portion located immediately behind the air outlet of each of the outside air paths, and a second deflecting portion located between the right and left outside air paths and transversely centrally of the helmet shell.

According to another aspect of the present invention, there is provided a shutter device for use in a helmet with a ventilating function, comprising: a base to be fitted on a helmet shell of the helmet, the base having a plurality of vent holes configured to coincide with a plurality of through-holes aligned longitudinally of and extending through the helmet shell; and a shutter plate slidably held on the base along a path defined in a path defining body longitudinally extending on an outer surface of the helmet shell and encompassing a fitted portion of the base, so as to adjustably open and close the vent holes of the base.

With this construction, the plurality of vent holes can be fully or partially opened and closed simultaneously by sliding the shutter plate on the base thereby regulating the air flow rate (suction rate of inside air by the negative pressure caused by the outside air flow) on the basis of the total area of opening of all the vent holes. Thus, this shutter device ensures sufficient amounts of intake outside air and sucked inside air in regulating the air flow rate without enlarging the size thereof, hence without marring the outward appearance of the whole helmet. In this way the fourth object of the invention is attained.

Further, the shutter device can be operated more easily than conventional ones because all the vent holes can be adjustably opened and closed by merely sliding the shutter plate. In addition, since the construction of this shutter device including the base and the shutter plate as basic components thereof is simple, the shutter device can be assembled and mounted with ease. Thus, the aforementioned fifth object of the present invention is attained.

The base may be a longitudinally extending one-piece member having a plurality of vent holes configured to coincide with all the corresponding through-holes of the helmet shell. Alternatively, the base may comprise a plurality of separate and independent bases each having a vent hole configured to coincide with a corresponding one of the through-holes. Such separate bases can be fitted on the spherical surface of the helmet shell easily. Further, the shutter device having such separate bases can be flexibly used on different helmet shells with different numbers of through-holes and different spacing between adjacent through-holes. Furthermore, each of the separate bases can be simplified in configuration and commonly used on different helmet shell configurations, thus leading to reduced costs.

Where the base comprises the plurality of separate bases, it is possible to provide a full open stopper for preventing sliding of the shutter plate once the vent openings have been fully opened by causing the shutter plate to interfere with at least one of the separate bases, and a full closure stopper for preventing sliding of the shutter plate once the vent holes have been fully closed by causing the shutter plate to interfere with at least one of the separate bases.

Preferably, one of the vent holes of the base configured to coincide with a foremost one of the through-holes of the helmet shell has a peripheral edge formed with an air flow guide raised on a rear side thereof. The air flow guide allows the air flow passing on the shutter plate to be partially guided into the through-hole thereby achieving efficient ventilation.

The shutter plate is preferably engaged with the base so as not to float above the base but to slide thereon. If the shutter plate is provided with a rear extension rearwardly extending through the air outlet of the path defining body, the rear extension can be used either as a portion to be formed with an operating knob or as an operating knob itself. Thus, the rear extension is an operating portion of the shutter device.

In this case, the rear extension is preferably provided with a projection for preventing chatter or vibration of the rear extension due to an air flow by abutting an internal top surface of the path defining body.

These and other objects, features and attendant advantages of the present invention will be more fully appreciated upon a reading of the following detailed description when considered in connection with the accompanying drawings.

DETAILED DESCRIPTION OF THE PREFERRED EMBODIMENTS

Figure 1:
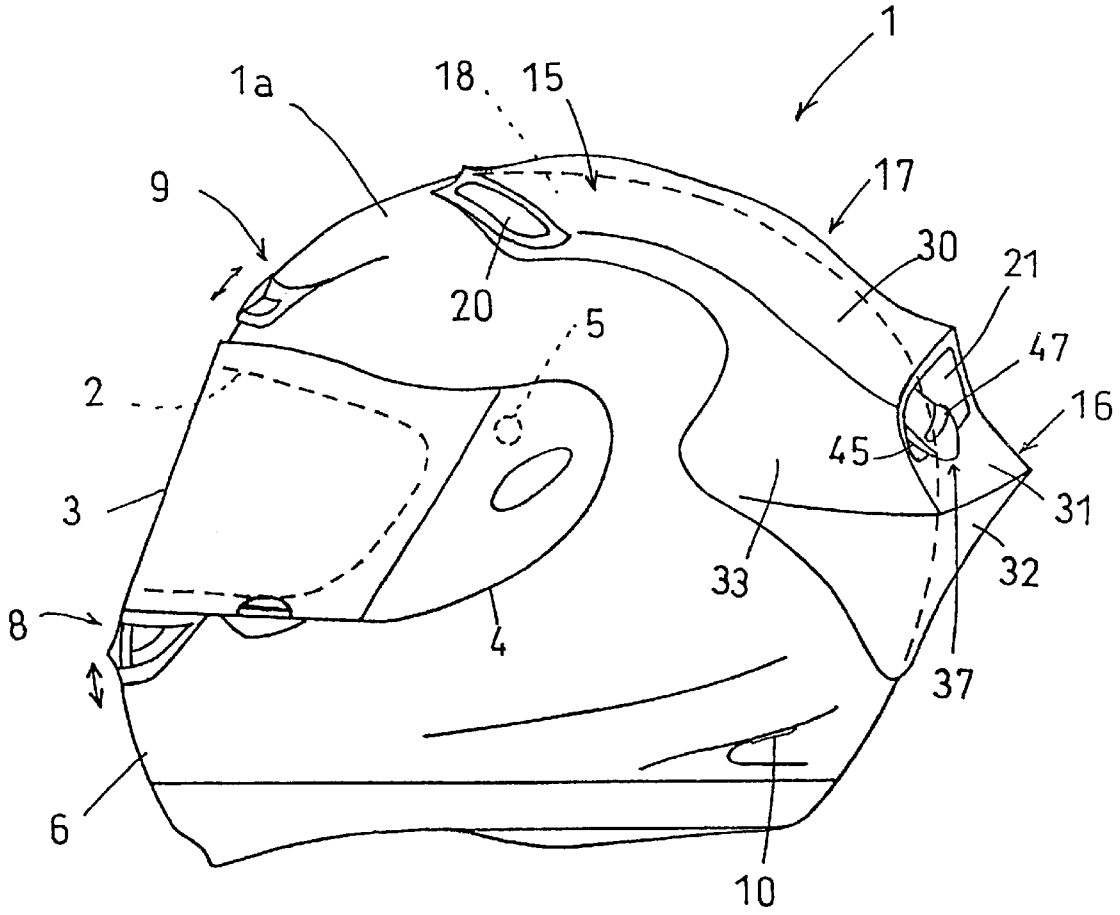
FIG. 1 is a side elevational view showing a helmet as a first embodiment of the present invention.

The present invention will now be described in detail with reference to the drawings.

Referring to FIGS. 1 to 8 showing a helmet 1 with a ventilating function as a first embodiment of the present invention, the helmet 1 is of the full-face type and for a rider of a motorcycle, particularly for use in racing. The helmet 1 includes a helmet shell 1*a* having a front portion defining an opening 2 for exposing the eyes of a user, and a shield 3 for covering the opening 2. This shield 3 is pivotable up and down about a pivot pin 5 hidden by each of a pair of ear covers 4 mounted on right and left sides of the opening 2, for opening/closing the opening 2.

The helmet 1 is provided with ventilating shutter devices 9 and 8 above and below the opening 2, respectively. Each of these shutter devices can be adjustably opened as desired by means of a slide operation knob (not shown) to introduce outside air into the helmet 1 as a conventional one does. Corresponding to the shutter devices 8 and 9, there are provided air vent holes 10 on rear lateral sides of the helmet shell 1*a* and another vent hole (not shown) at a lower rear edge of the helmet 1.

It should be noted that the present invention is not limited to the shapes of detailed structures and the use of the helmet 1.

The helmet 1 is provided on the helmet shell 1*a* thereof with an integrally molded component 17 unifying a path defining body 15 and a rear deflector 16 and extending from a top portion to a rear portion of the helmet shell 1*a*. As apparent from FIGS. 2 and 5, the integrally molded component 17 has a pair of longitudinally extending path defining bodies 15 kept spaced a predetermined distance from each other in the transverse direction (in the vertical direction in FIG. 5). The rear deflector 16 is configured as interconnecting the rear ends (on the right-hand side in FIG. 5) of the path defining bodies 15.

The integrally molded component 17 is as thin as about 1 to about 1.5 mm and is formed of a resin material such as polyethylene, polypropylene, acrylic resin, ABS or polycarbonate. Though the thickness of the integrally molded component 17 is not particularly limited, the molded component 17 is preferably made thin to lighten the weight thereof so long as the required strength is ensured. The integrally molded component 17 is configured so that entire outer periphery 17*a* thereof fits the spherical outer surface of the helmet shell 1*a* without any clearance therebetween and that the portions corresponding to the path defining bodies 15 and rear deflector 16 are bulged.

The outer periphery 17*a* of the integrally molded component 17 is a continuous endless narrow band area on which an appropriate bonding member (not shown) is provided for the fitting of the molded component 17 on the helmet shell 1*a*. Such bonding members include, for example, dual-sided adhesive tapes, various adhesives, screws, and rivets.

Figure 4:
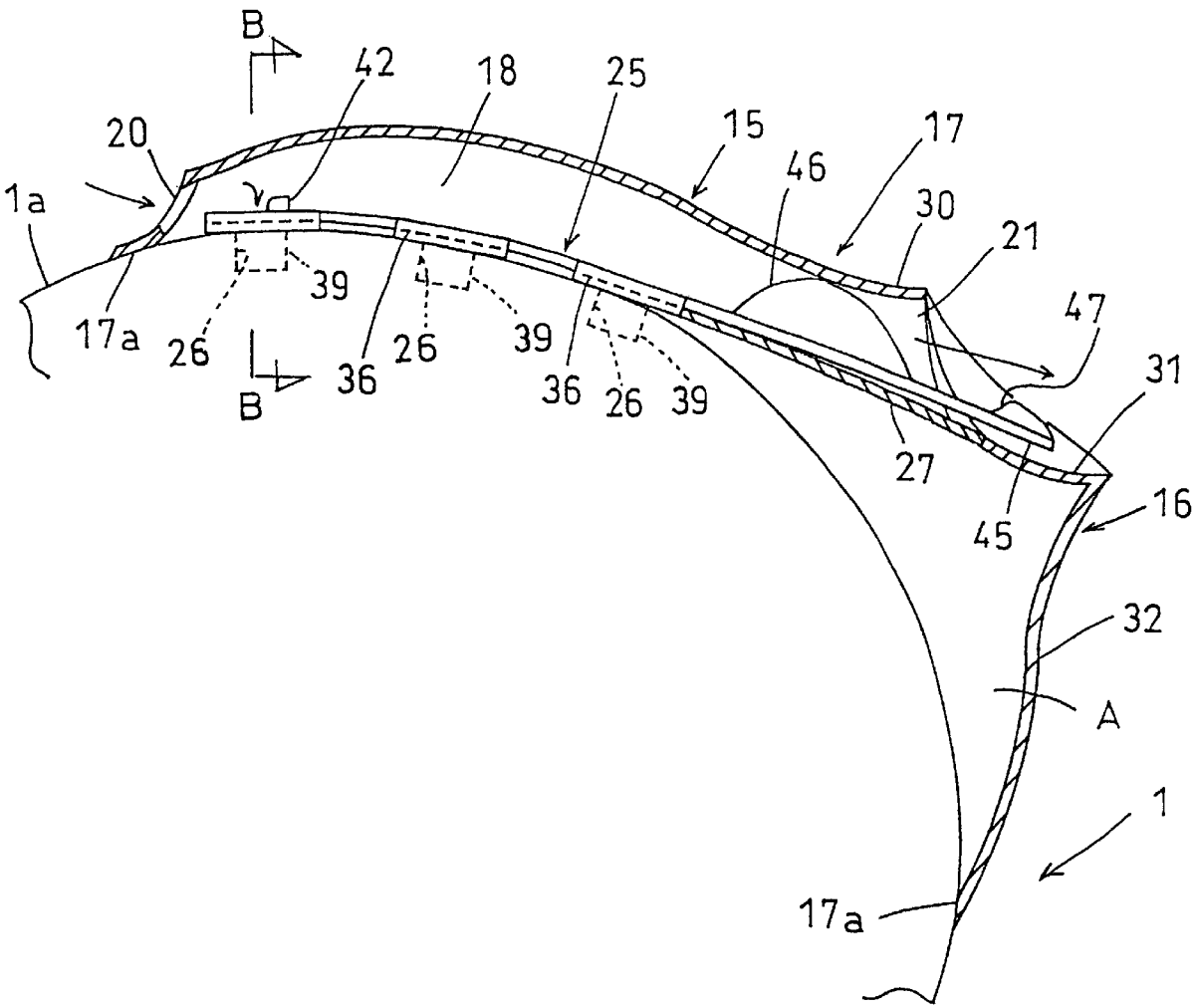
FIG. 4 is an enlarged sectional view taken on line A—A of FIG. 2.

As shown in FIG. 4, when the integrally molded component 17 is fitted on the helmet shell 1*a*, hollow portions corresponding to the path defining bodies 15 and rear deflector 16 (bulged portions) are defined therein. The hollow portion defined by each of the path defining bodies 15 serves as an outside air path 18, and the path defining bodies 15 each have an air inlet 20 at the front end thereof for introducing outside air into the outside air path 18 and an air outlet 21 at the rear end thereof for allowing the intake outside air to flow out rearwardly of the helmet shell 1*a*. Inside air remaining in within the helmet 1 is sucked by the negative pressure of the outside air flow through the outside air path for ventilation.

Figure 6:
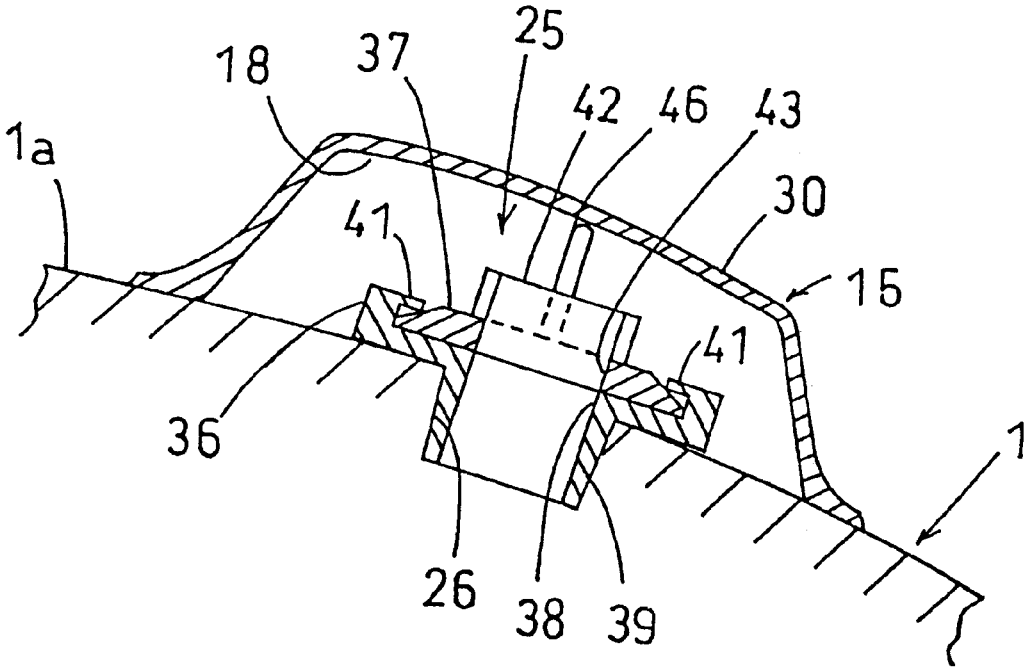
FIG. 6 is an enlarged sectional view taken on line B—B of FIG. 4.

As shown in FIGS. 4 and 6, a shutter device 25 is mounted on the helmet shell 1*a* within each outside air path 18 in a manner to cover through-holes 26 extending inwardly through the helmet shell 1*a*. When the shutter device 25 opens the through-holes 26, air introduced through the air inlet 20 partially flows into the helmet 1 through the through-holes 26 and air remaining within the helmet 1 is sucked up into the outside air path 18 by the negative pressure caused by the air flow passing through the outside air path 18. In this way, the inside of the helmet 1 is ventilated and the user's head is cooled.

Figure 8:
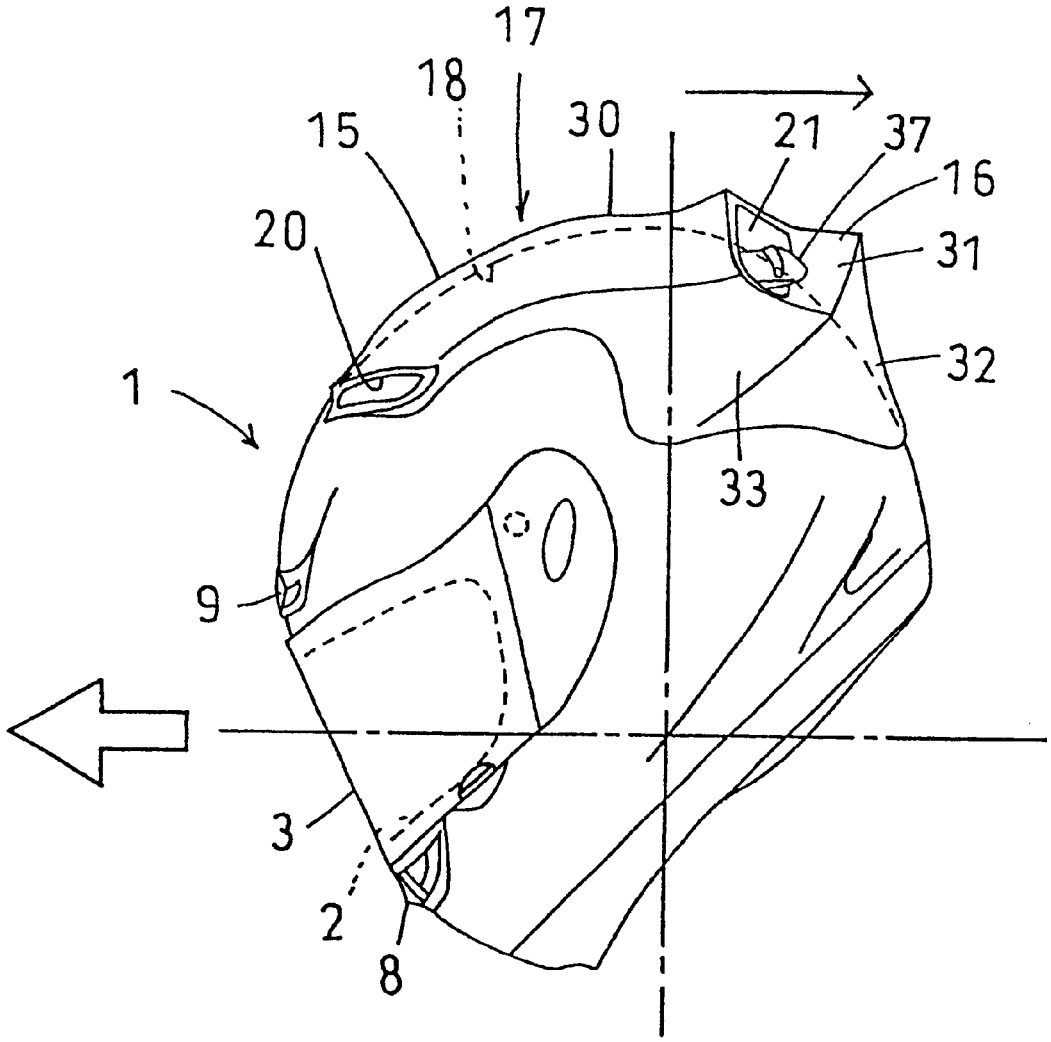
FIG. 8 is a side view of the helmet of the first embodiment in a use position.

As shown in FIG. 8, the air outlet 21 of each path defining body 15 is formed to orient along a line tangential to the helmet shell 1*a* which forms an angle of use relative to the axis of the helmet 1. The angle of use is the angle at which the helmet wearer rides a motorcycle or the like in a forwardly inclined posture.

Figure 5:
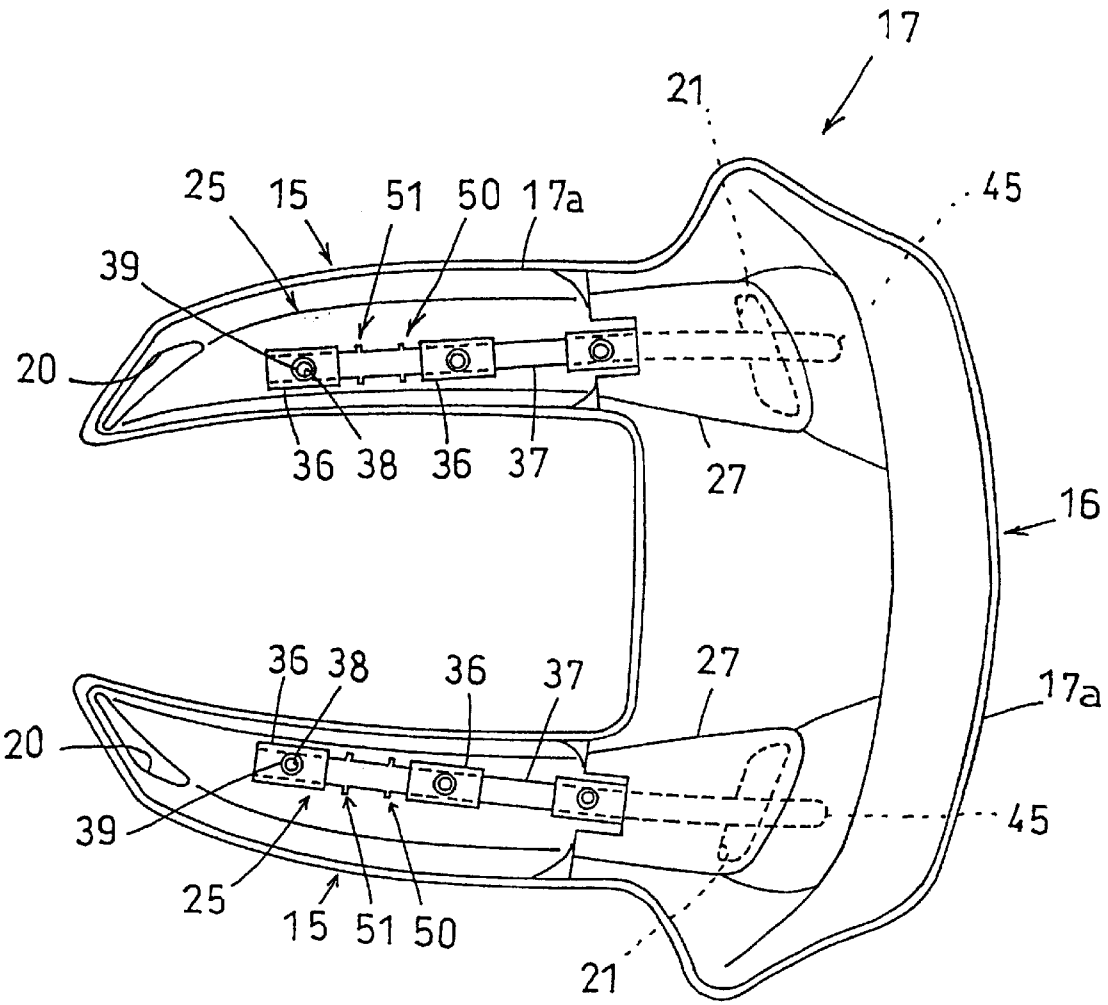
FIG. 5 is a bottom view showing an integrally molded component including a path defining body and a rear deflector used in the first embodiment.

As shown in FIG. 5, a bottom plate 27 is provided within each outside air path 18 in order for air passing through the path 18 to flow as straight as possible without significant stagnation and turbulence.

The rear deflector 16 is adapted to prevent air release from occurring dispersedly at different places on the outer surface of the helmet shell 1*a* and then cause air to be released from the helmet 1 concentratedly and smoothly on the rear side of the helmet shell 1*a*. The rear deflector 16 includes a top wall 30 that forms part of a top surface of each path defining body 15 and extends rearwardly of the helmet 1, an outlet extension 31 that immediately and continuously follows each air outlet 21 and extends rearward, a lower rear portion 32 extending downwardly from the rear edge of the outlet extension 31 to a rear outer surface of the helmet shell 1*a*, and a side portion 33 interconnecting the lateral side of the top wall 30 and that of the outlet extension 31.

The top wall 30 and the outlet extension 31 are both inwardly curved as shown in FIG. 4 to make air passing thereon flow substantially parallel with a road surface when the helmet 1 is at the angle of use. This arrangement can place the wind release points of the top wall 30 and outlet extension 31 as rearwardly and upwardly possible to suppress the occurrence of negative pressure and turbulence at a rear portion of the helmet shell 1*a*, with the result that the air resistance to the helmet 1 can be minimized and the fitting stability of the helmet 1 on the wearer riding a motorcycle or the like can be enhanced, thereby mitigating the burden on the neck muscles of the wearer.

Though the concave surface of the top wall 30 plays the major part of the air flow releasing action of the helmet 1, the concave surface of the outlet extension 31 acts to facilitate the release of air flow (mixture of outside air and inside air) discharged from the air outlet 21 of each path defining body 15.

When the rear deflector 16 is viewed in side elevation, the lower rear portion 32 is angled so that the rear edge of each outlet extension 31 forms an acute angle to facilitate the release of air flow from the outlet extension 31. In this arrangement, a hollow portion A is defined between the rear deflector and an outer surface of the helmet shell 1*a*, as best shown in FIG. 4.

The overall configuration of the rear deflector 16 is streamlined or smoothly waved so that the wind flowing along the helmet 1 at the angle of use exhibits a continuous smooth flow. As described above, the main object of the rear deflector 16 is to release the air flow collectively on the rear side of the helmet shell 1*a* (at the rear ends of the top wall 30 and outlet extension 31). To attain this object, other portions than the rear ends of the top wall 30 and outlet extension 31 are required to keep the air flow smooth in line therewith while inhibiting the occurrence of air flow release therefrom.

The lengths of the rearwardly protruding portions of the top wall 30 and outlet extension 31 and the angle formed between the outlet extension 31 and the lower rear portion 32 are determined so that the helmet 1 does not receive a great air resistance when the helmet wearer turns the face sideways in a high-speed traveling or in a running on a curve, or when the helmet wearer receives a strong side wind in a straight running.

Figure 2:
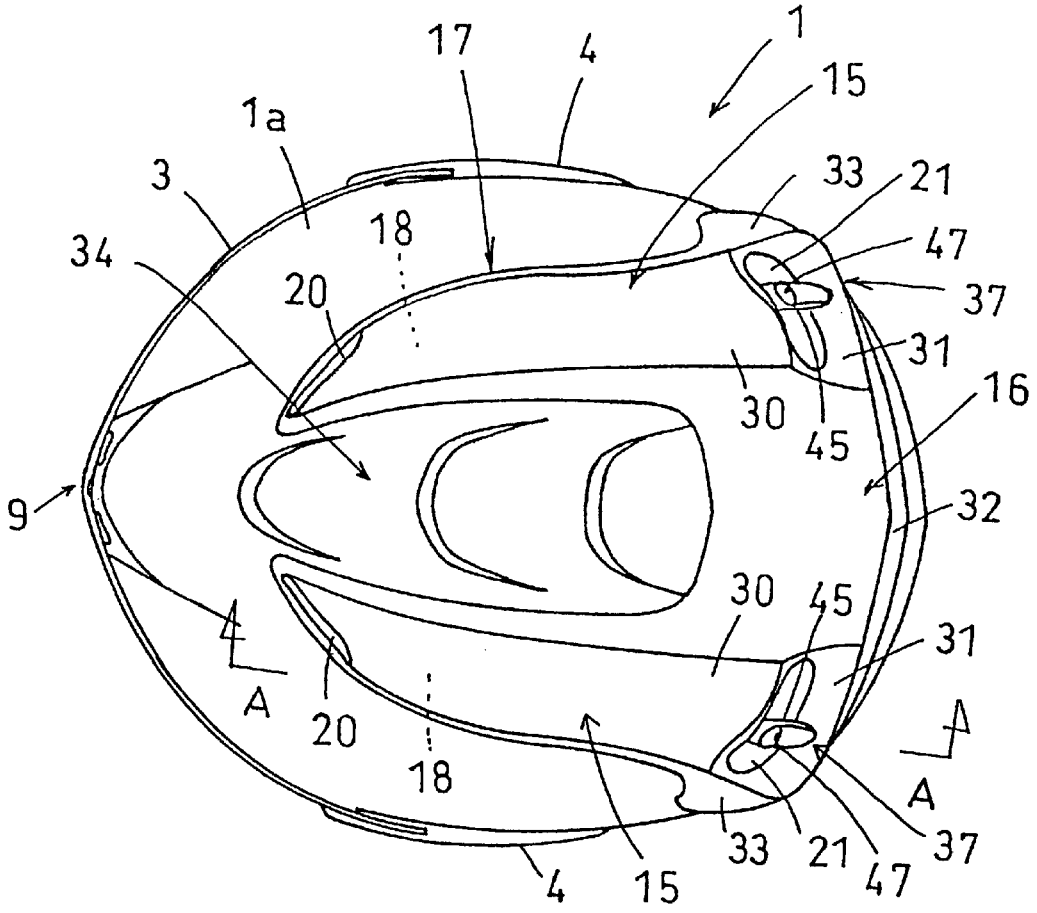
FIG. 2 is a top plan view of the helmet shown in FIG. 1.
Figure 3:
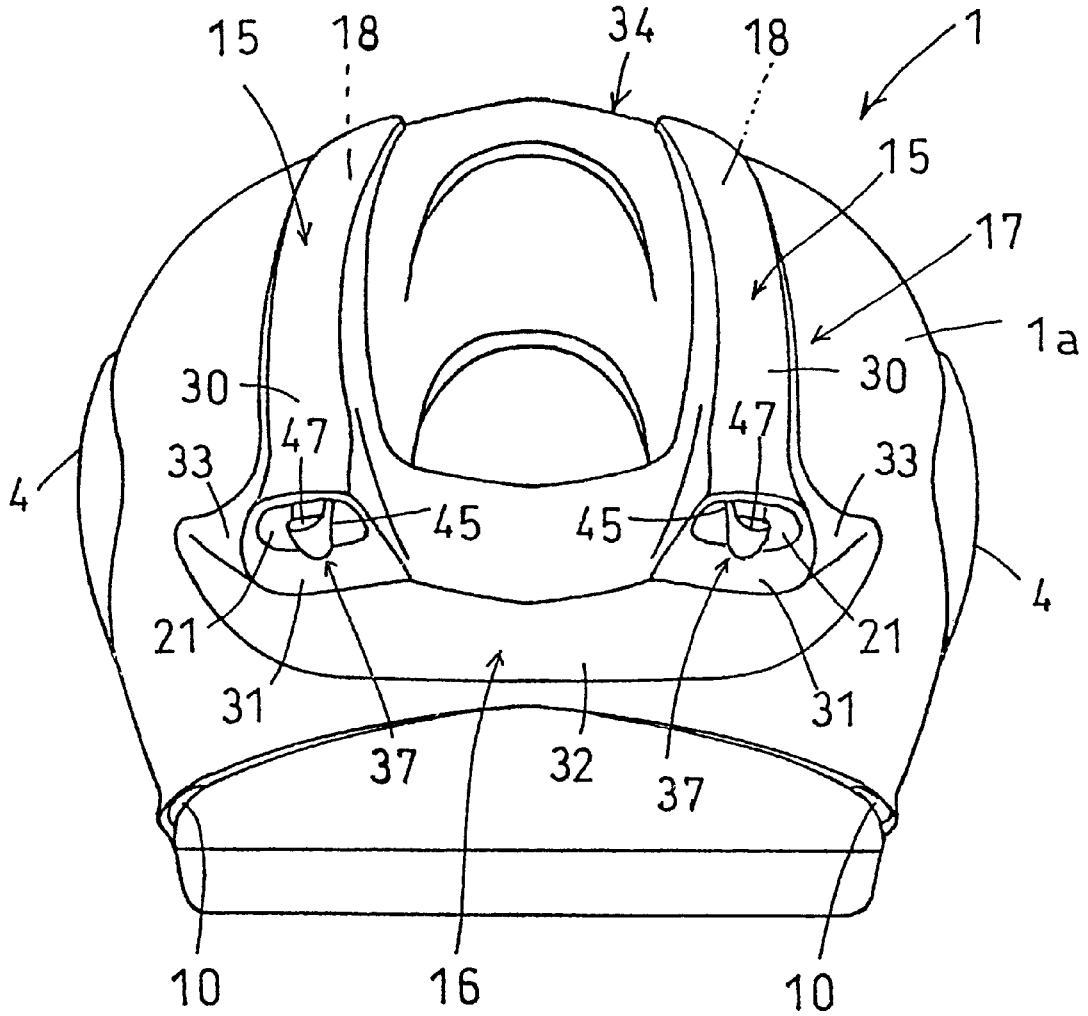
FIG. 3 is a rear elevational view of the helmet shown in FIG. 1.

Since the two top walls 30 are bulged, a longitudinally extending recess 34 is formed between the two top walls 30 as shown in FIGS. 2 and 3. This recess 34 guides a wind straight thereby enhancing the fitting stability of the helmet 1 on the rider in the wind.

The integrally molded component 17 may be formed by any molding process without limitation, but preferably by injection molding, vacuum forming, air-pressure forming or a like process because these processes enable a product to have a thickness of about 1 to about 1.5 mm or smaller, are adaptable for the molding of a complicated three-dimensional article with a high precision, and require a lower cost.

As shown in FIGS. 4 to 7, the aforementioned shutter device 25 comprises a base 36 and a shutter plate 37. The base 36 comprises a plurality of separate and independent bases corresponding to a plurality of through-holes 26 communicating with the inside of the helmet 1 and aligned longitudinally of the helmet shell 1*a*. Each separate base 36 has a single vent hole 38 for communication with each corresponding through-hole 26.

Each separate base 36 is provided with a fitting tube 39 protruding downwardly from the peripheral edge of the vent hole 38. By fitting the fitting tube 39 into the corresponding through-hole 26, the base 36 is well-positioned with respect to the helmet shell 1*a* without likelihood of rattling. Each separate base 36 is also provided with a pair of opposite hooks protruding upwardly from opposite side edges thereof to embrace the shutter plate 37.

The separate base 36 located at the foremost position on the helmet shell 1*a* is provided with a semicircular air flow guide 42 standing upright on the rear side of the peripheral edge of the vent hole 38. The air flow guide 42 functions to introduce partially the outside air flow passing on the shutter plate 37 from the air inlet 20 to the air outlet 21 into the inside of the helmet 1 through the vent hole 38 and the corresponding through-hole 26.

The shutter plate 37 is an elongate strip extending longitudinally in the outside air path 18 and formed of a resin material having flexibility and elasticity in the direction of thickness. The shutter plate 37 is slidably engaged with the pair of hooks 41 of each separate base 36 so as not to float above the plurality of separate bases 36 but to slide longitudinally thereon.

The shutter plate 37 defines a plurality of perforations 43 corresponding to all the vent holes 38 of the separate bases 36 at the same pitch as with the through-holes 26. Thus, by sliding the shutter plate 37 on the separate bases 36, the degree of opening of each through-hole 26, determined as an overlapping area of the corresponding vent hole 38 and perforation 43, can be adjusted.

As shown in FIGS. 1 to 4, the shutter plate 37 has a length such as to extend rearwardly beyond the rearmost separate base 36 and slightly protrude from the air outlet 21 of each path defining body 15. The portion rearwardly extending from the position of the rearmost separate base 36 is referred to as a rear extension 45. The rear extension 45 is provided with a thin rear projection 46 having a semicircular configuration in side view, and a knob 47 for sliding the shutter plate 37. The rear projection 46 has an upper edge capable of abutting an inner top surface of the path defining body 15 to keep the shutter plate 37 on the bottom (particularly bottom plate 27) of the outside air path 18 thereby preventing noisy chatter or vibration of the shutter plate 37 (particularly the rear extension 45). The knob 47 is adapted to be caught by fingers of the user so as to push-pull the shutter plate 37.

Figure 7:
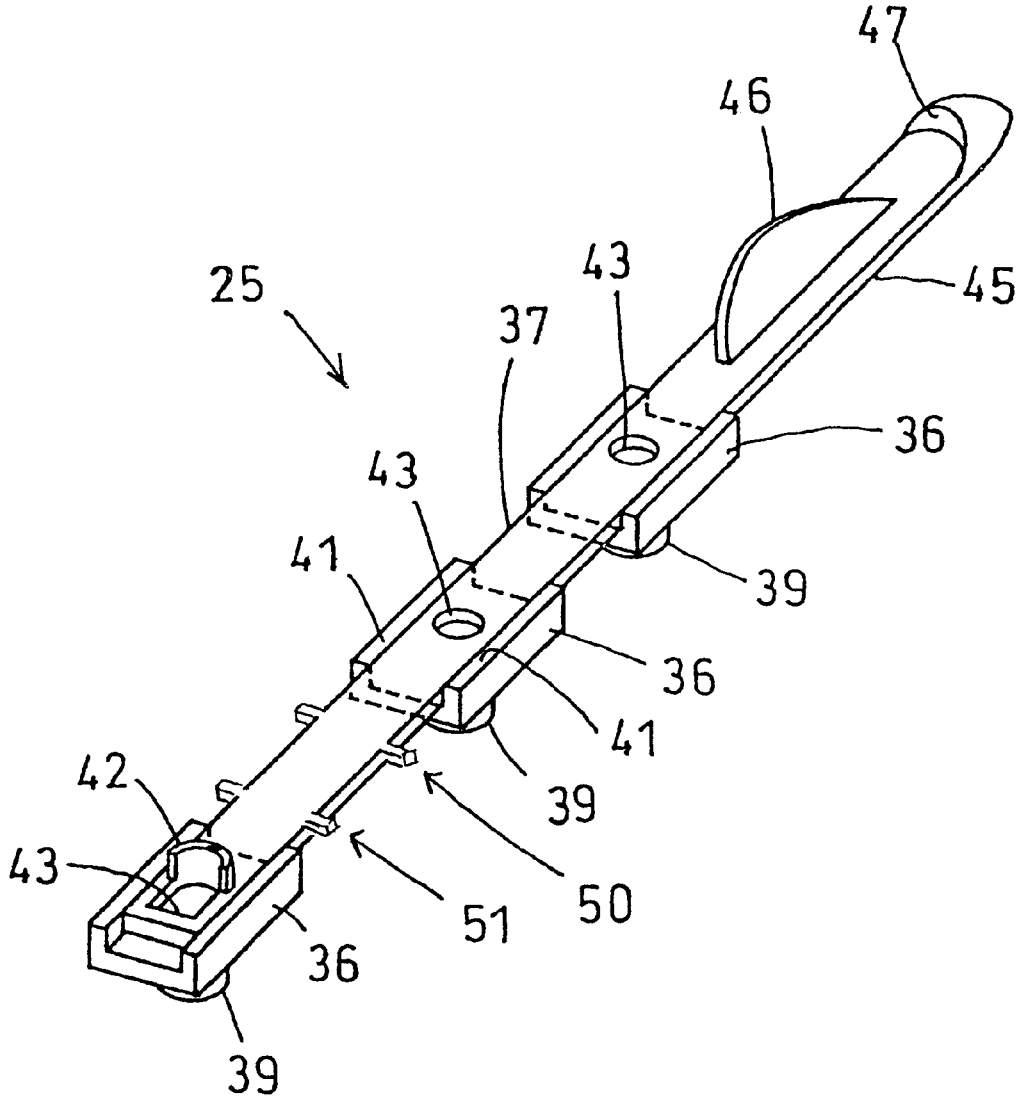
FIG. 7 is a perspective view showing a shutter device employed in the first embodiment.

As shown in FIGS. 5 and 7, the portion of the shutter plate 37 positioned between the foremost base and the central base is provided with a full-open stopper 50 comprising a pair of opposite lateral projections and a full-closure stopper 51 comprising a pair of opposite lateral projections. The full-open stopper 50 comes to abut the central base 36 so as to stop the rearward sliding of the shutter plate 37 once the vent holes 38 (hence, the through-holes 26) have been fully opened by the shutter plate 37 sliding rearward. On the other hand, the full-closure stopper 51 comes to abut the foremost base 36 so as to stop the forward sliding of the shutter plate 37 once the vent holes (hence, the through-holes 26) have been fully closed by the shutter plate 37 sliding forward.

According to this embodiment, the helmet 1 has the integrally molded component 17 in which the path defining bodies 15 and the rear deflector 16 are unified. Consequently, the helmet 1 enjoys both the ventilating function and the deflecting function and exhibits an attractive unified appearance.

Further, the rear deflector 16 deflects not only the air flow passing along the outer surface of the helmet 1 but also the outgoing air flow from the air outlets 21 of the path defining bodies 15. Thus, the air flow releasing action is synergistically enhanced. Also, since the outgoing air flow from the air outlet 21 is deflected by the rear deflector 16, the ventilating action is synergistically enhanced.

Furthermore, the recess 34 defined between the pair of longitudinally elongated tunnel-like outside air paths 18 functions to guide the air flow straight relative to the rear deflector 16 thereby improving the fitting stability of the helmet 1 in the wind.

On the other hand, the shutter device 25 according to the present invention is capable of adjusting the opening of the plurality of through-holes 26 extending through the helmet shell 1*a* at a time if merely the knob 47 of the rear extension 45 exposed at the air outlet 21 is push-pull operated. The shutter device 25 is of a simplified construction requiring an easy operation and ensuring a sufficient amount of intake outside air without scaling up the size thereof and marring the outward appearance thereof.

Figure 9:
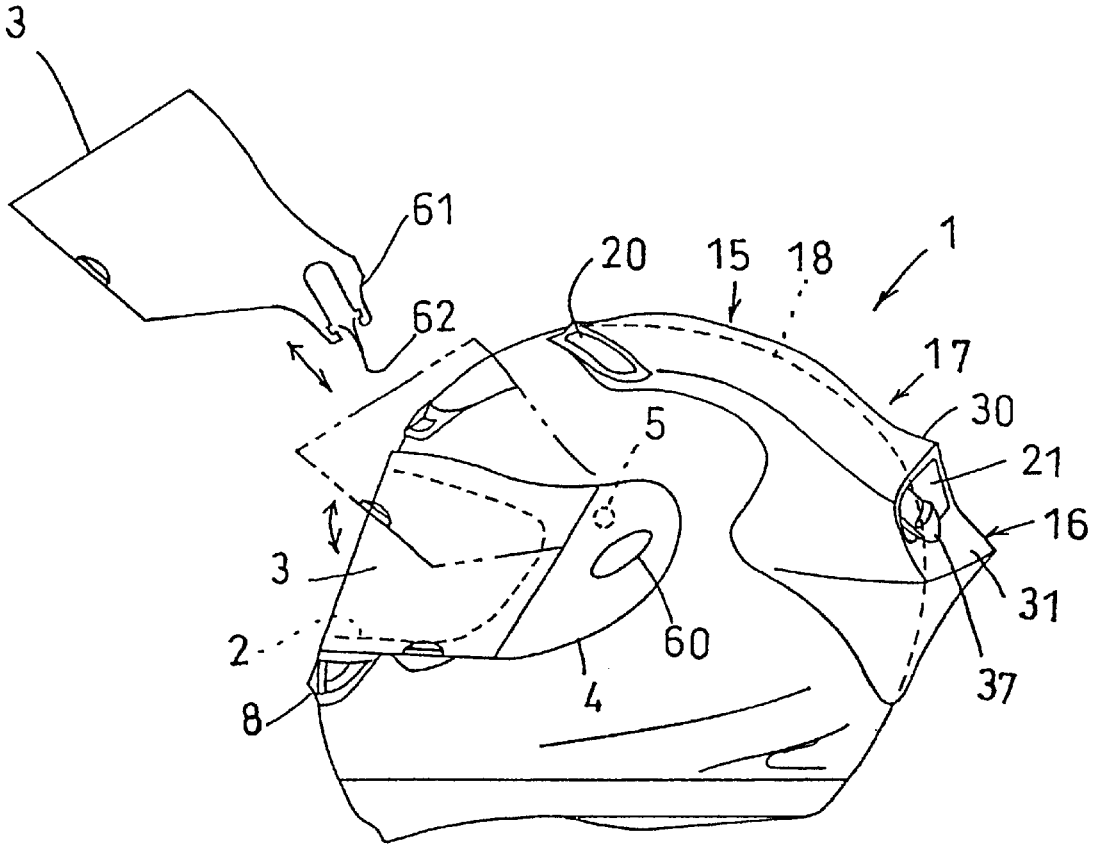
FIG. 9 is a side elevational view illustrating an additional structure related to a shield employed in the first embodiment.
Figure 10:
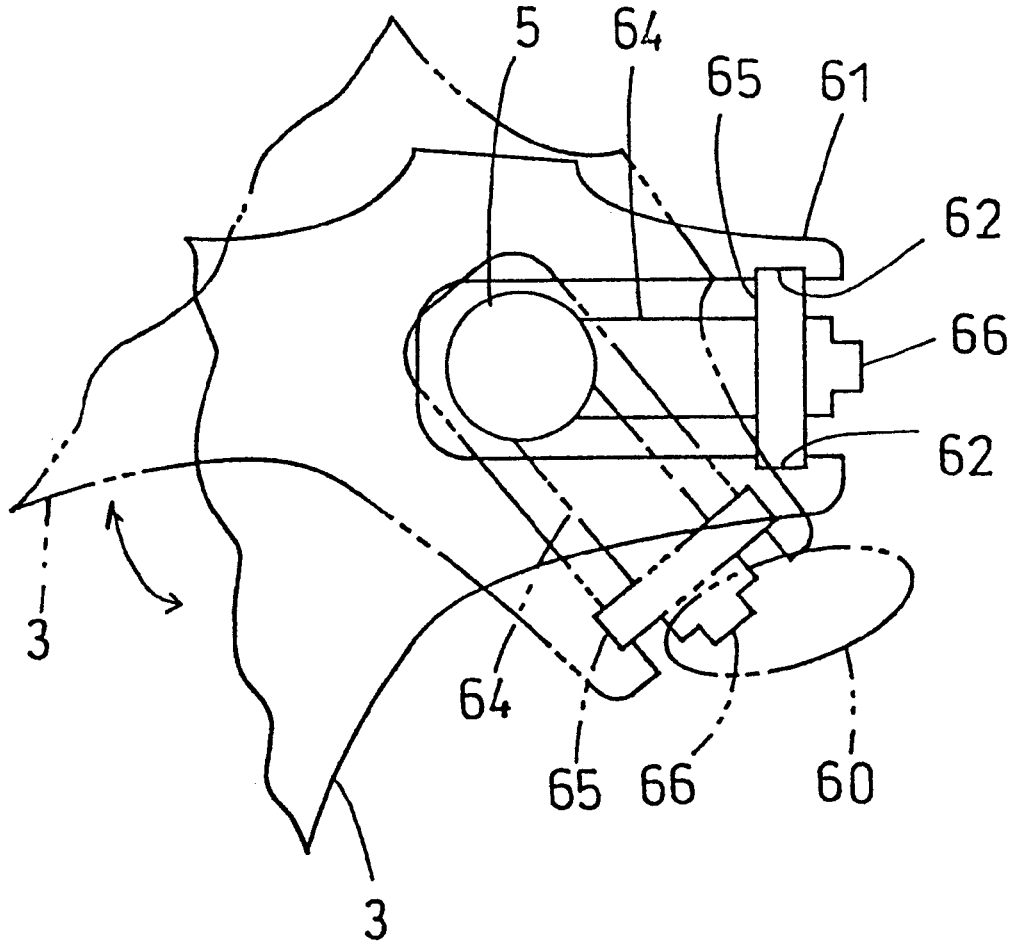
FIG. 10 is an enlarged fragmentary view of a portion of the additional structure of FIG. 9 around the pivoting axis of the shield.
Figure 11:
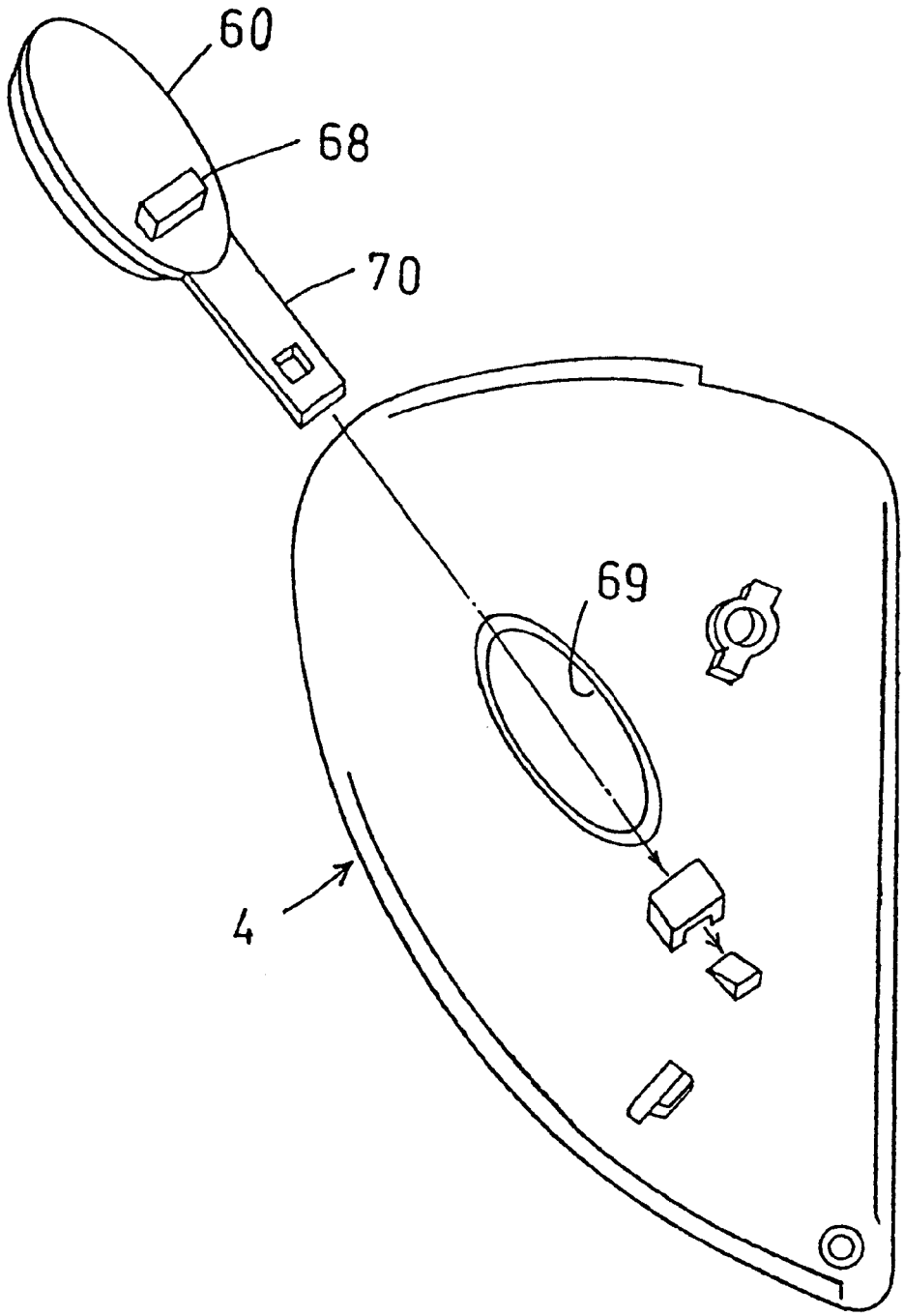
FIG. 11 is an enlarged, exploded reverse-side view showing an ear cover forming part of the additional structure shown in FIG. 9.

In the first embodiment, an additional structure for fitting a shield 3 is employed in order to mitigate the occurrence of noise. As shown in FIGS. 9 to 11, the shield 3 is upwardly and downwardly pivotable about pivot pins 5 and is not removable when in a lower position to close an opening 2 (adapted to expose the eyes of the user) and even when in an upper position to open the opening 2. The shield 3 can be removed only when an elliptic button 60 located in each of opposite ear covers 4 is kept pressed with the shield 3 in the upper (open) position. To realize this feature, the shield 3 is provided with a bifurcated insert 61 to be inserted into each ear cover 4. This insert 61 defines vertically opposite notches 62 to form hooks.

Corresponding to the insert 61, the helmet 1 is provided with a radially outwardly extending elastic projection piece 64 which is rotatable with each pivot pin 5 and is formed adjacent its tip with a stopper 65 that is engageable with the notches 62 of the insert 61. The elastic projection piece 64 is elastically deformable in directions toward and away from the helmet shell 1*a*. The tip of the elastic projection piece 64 forms an operation receiving portion 66 to be pressed by the corresponding button 60.

The button 60 in each ear cover 4 has on the reverse side thereof a pressing projection 68 in a position such as to abut the operation receiving portion 66 when the shield 3 is in the upper (open) position. The button 60 is fitted into a button hole 69 of the same elliptic configuration defined in each ear cover 4 from the reverse side thereof so as not to shake and is biased toward the reverse side of the ear cover 4 by an elastic support 70 to keep the button 69 protruding outwardly from the button hole 69.

With this structure, only when the button 60 is kept pressed with the shield 3 in the upper (open) position, the operation receiving piece 66 can be pressed inward by the pressing projection 68 of the button 60 to detach the stopper 65 from the notches 62 thereby removing the shield 3 from the helmet 1. Since the button 60 is fitted into the button hole 69 of the corresponding ear cover 4 so as not to shake and is constantly biased toward the ear cover 4, this feature prevent entry of a wind into the helmet 1 through the clearance between the outer periphery of the button 60 and the peripheral edge of the button hole 69.

This results in the helmet 1 preventing chatter or vibration of the shield 3 in a high-speed traveling or a like condition to reduce noise. With the conventional structure, in contrast, a shield is subject to chatter or vibration due to the entry of a wind through a slit formed in each ear cover for the fitting and removal of the shield (refer to, for example, Japanese Patent No. 2702397).

Figure 12A:
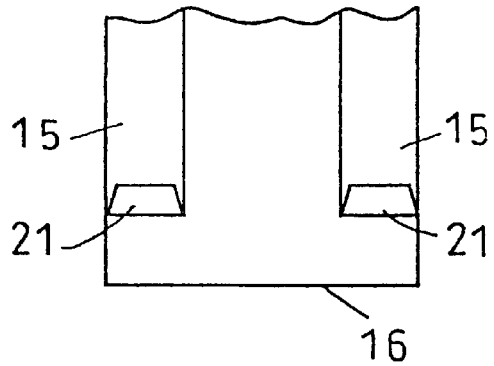
FIGS. 12(*a*), 12(*b*) and 12(*c*) are schematic views showing variations of a helmet having two path defining bodies according to the present invention.
Figure 12B:
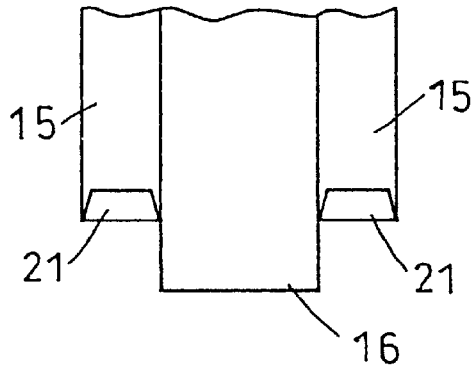
Figure 12C:
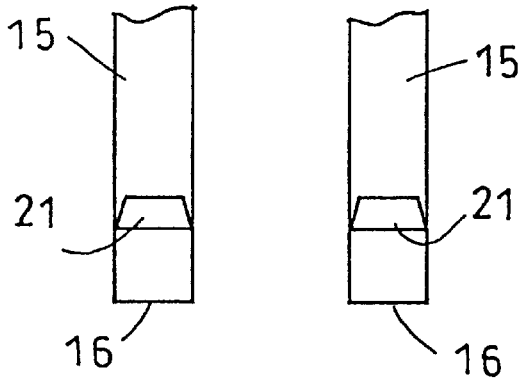

FIG. 12(*a*) schematically illustrates the arrangement of the path defining bodies 15 and the rear deflector wherein the rear deflector 16 is integral with the portions immediately following the pair of right and left path defining bodies 15 and the portion formed between the pair of path defining bodies 15. This arrangement may be modified into that shown in FIG. 12(*b*) in which the rear deflector 16 is integral only with the portion formed between the pair of right and left path defining bodies 15, or alternatively, that shown in FIG. 12(*c*) in which the rear deflector 16 is integral only with the portions immediately following the two path defining bodies 15.

Figure 13A:
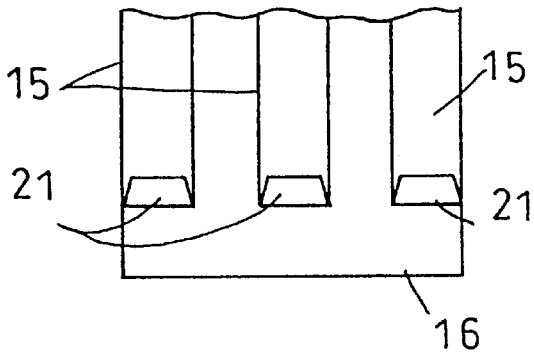
FIGS. 13(*a*), 13(*b*) and 13(*c*) are schematic views showing variations of a helmet having three path defining bodies according to the present invention.
Figure 13B:
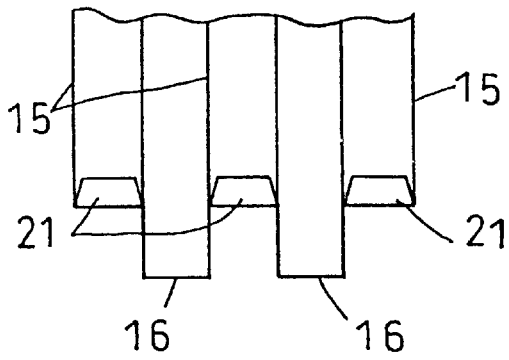
Figure 13C:
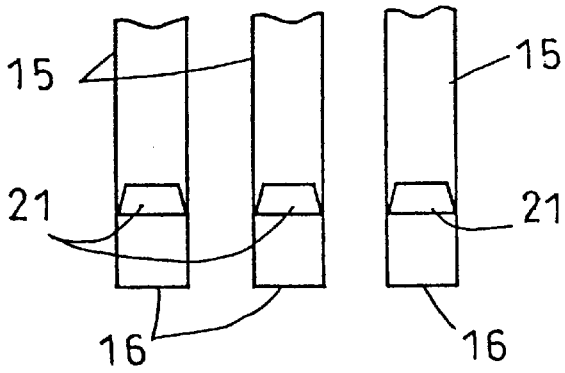

FIG. 13(*a*) schematically illustrates another embodiment in which: three path defining bodies 15, namely, right and left ones and a central one, are formed; and the rear deflector 16 is integral with the portions immediately following the three path defining bodies 15 and the portions formed between the path defining bodies 15. This embodiment may be modified into that shown in FIG. 13(*b*) in which the rear deflector 16 is integral only with the portions formed between the three path defining bodies 15, or alternatively, that shown in FIG. 13(*c*) in which the rear deflector 16 is integral only with the portions immediately following the three path defining bodies 15.

Figure 14A:
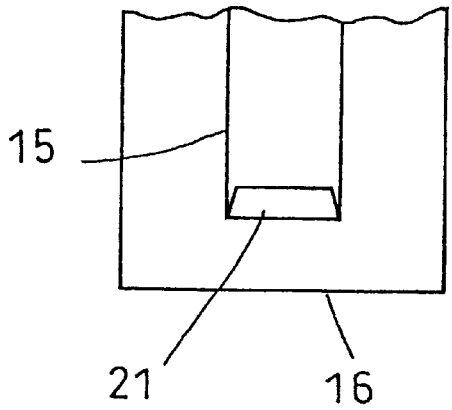
FIGS. 14(*a*), 14(*b*) and 14(*c*) are schematic views showing variations of a helmet having a single path defining body according to the present invention.
Figure 14B:
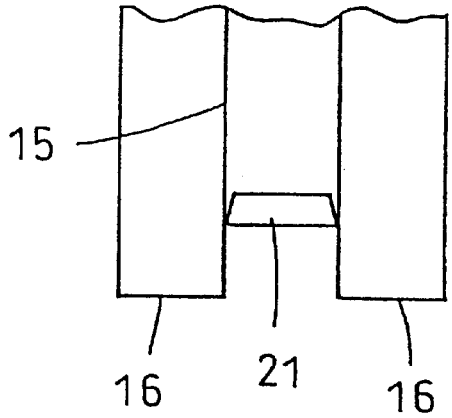
Figure 14C:
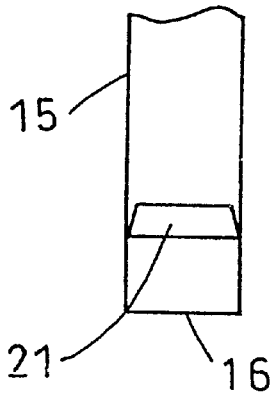

FIG. 14(*a*) schematically illustrates yet another embodiment in which only a single path defining body 15 is formed transversely centrally of the helmet shell 1*a*; and the rear deflector 16 is integral with the portion immediately following the path defining body 15 and the opposite side portions extending laterally from the path defining body 15. This embodiment may be modified into that shown in FIG. 14(*b*) in which the rear deflector 16 is integral only with the opposite side portions extending laterally from the path defining body 15, or alternatively, that shown in FIG. 14(*c*) in which the rear deflector 16 is integral only with the portion immediately following the path defining body 15.

Otherwise, it is possible to form four path defining bodies 15. In this case, the rear deflector 16 may be integral with those portions selected from the portions immediately following the four path defining bodies 15 and with those portions selected from the portions between the path defining bodies 15.

Figure 15:
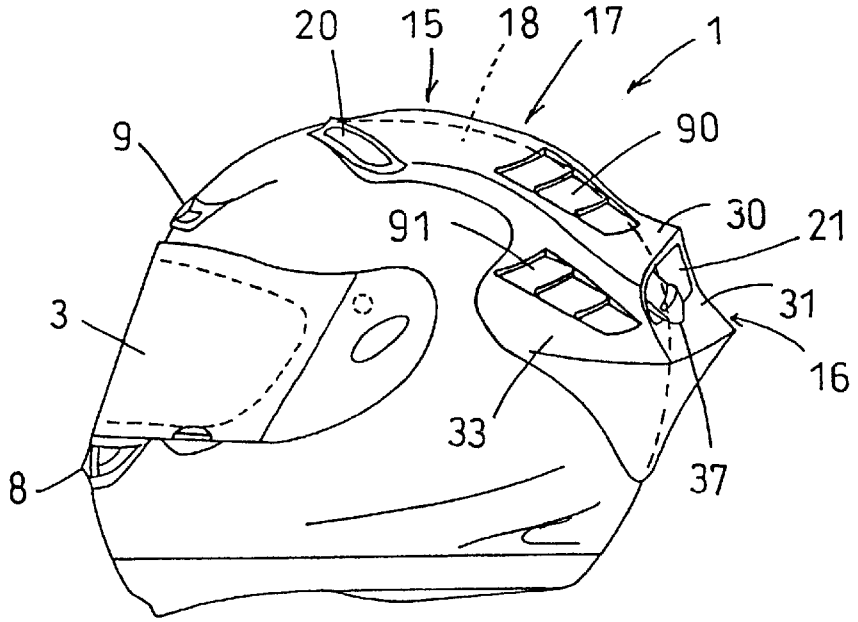
FIG. 15 is a side elevational view showing a helmet provided with a variation of the rear deflector according to the present invention.

As shown in FIG. 15, the rear deflector 16 may be provided with longitudinally extending series of steps on the top wall 30 of each path defining body 15 and on each side portion 33 as release inducing portions 90 and 91. The release inducing portions 90 and 91 induce localized air flow releases before the air flow reaches the rear ends of the top wall 30 and outlet extension 31 thereby enhancing the final air flow release at these rear ends. Such a localized air flow release induced by the release inducing portion 90 or 91 does not cause any problematic turbulence, unlike an air flow release that is expected to occur at an intermediate portion of the top wall 30 or the side portion 33 if the top wall 30 or the side portion 33 is made flat.

Figure 16:
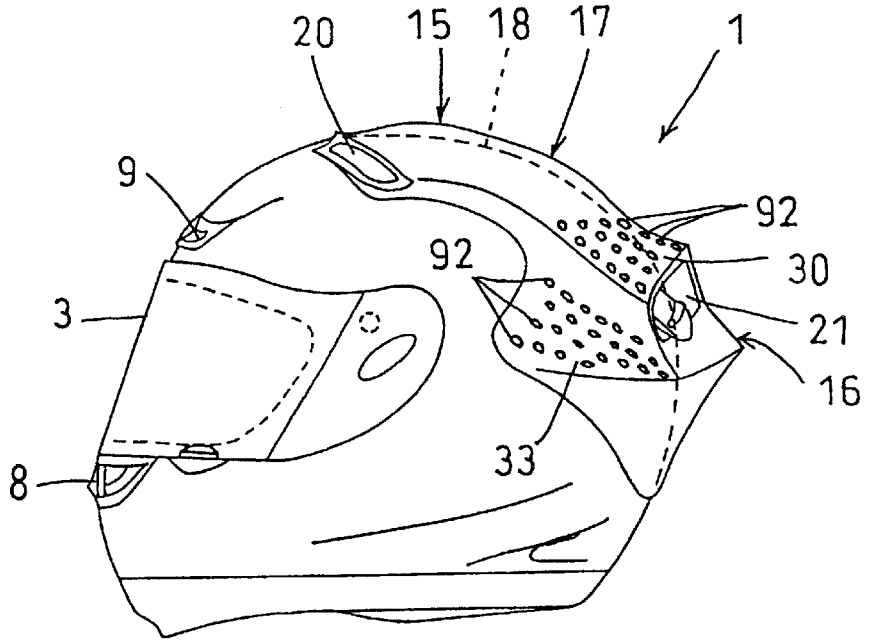
FIG. 16 is a side elevational view showing a helmet provided with another variation of the rear deflector according to the present invention.

Alternatively, as shown in FIG. 16, the top wall 30 and side portion 33 each may be formed with a dimpled surface defining a multiplicity of small circular recesses 92. Like the release inducing portions 90 and 91, such a dimpled surface induces localized air flow releases thereby enhancing the final air flow release at the rear ends of the top wall 30 and outlet extension 31.

It should be noted that the present invention is applicable to helmets of any type and any application. Thus, the helmet and shutter device of the present invention can be used by a driver of a four-wheel vehicle or the like. In this case, the angle of use of the helmet is somewhat different from that of the helmet for a motorcyclist and, hence, the rear deflector 16 should be appropriately modified in configuration to accommodate itself to such a difference.

While certain presently preferred embodiments of the present invention have been described in detail, as will be apparent for those familiar with the art, certain changes and modifications can be made in embodiments without departing from the spirit and scope of the present invention as defined by the following claims.

What is claimed is:

1. A helmet with a ventilating function comprising:

a helmet shell having on an outer surface thereof a longitudinally extending outside air path configured to introduce outside air thereinto from a front air inlet of said helmet and discharge the air rearwardly from a rear air outlet to form an outside air flow that sucks inside air remaining in the helmet shell by its negative pressure to achieve ventilation;

a path defining body defining the outside air path; and a rear deflector for facilitating release of an air flow from a rear portion of the outer surface of the helmet shell, the path defining body and the rear deflector being unified in configuration, the rear deflector including an outlet extension that immediately and continuously follows said air outlet and extends rearwardly with respect to said helmet, and a top wall that forms part of a top surface of the path defining body, wherein both said top wall and said outlet extension have portions inwardly curved with respect to said helmet to make air upwardly flow at a rear end of the path defining body.

2. A helmet with a ventilating function as set forth in claim 1, wherein the air outlet of the outside air path is oriented along a line tangential to the helmet shell that forms an angle of use relative to an axis of the helmet shell in use at which the helmet shell is used and said rear deflector includes a lower rear portion extending downwardly from a rear end of the outlet extension to a rear outer surface of the helmet shell and forms an acute angle between the lower rear portion and the outlet extension.

3. A helmet with a ventilating function as set forth in claim 1, wherein the rear deflector is located immediately behind the air outlet.

4. A helmet with a ventilating function as set forth in claim 2, wherein the rear deflector is located immediately behind the air outlet.

5. A helmet with a ventilating function as set forth in claim 2, wherein the path defining body defines a plurality of outside air paths parting on at least right and left sides of the helmet shell; and the rear deflector comprises a first deflecting portion located immediately behind the air outlet of each of the outside air paths and a second deflecting portion located between right and left sides of the outside air paths.

6. A helmet with a ventilating function as set forth in claim 2, wherein the path defining body defines a plurality of outside air paths parting on at least right and left sides of the helmet shell; and the rear deflector comprises a deflecting portion located between the right and left sides of the outside air paths; and the lower rear portion extends downward with respect to said helmet shell from a rear end of the deflecting portion of the rear deflector.

7. A helmet with a ventilating function as set forth in claim 2, wherein the path defining body defines a plurality of outside air paths parting on at least right and left sides of the helmet shell; and a longitudinally extending recess is formed between the path defining bodies provided on the right and left sides of the helmet shell in order to guide additional airflows straight.

8. A helmet with a ventilating function having a helmet shell, a longitudinally extending outside air path having a front inlet and a rear air outlet, a plurality of through holes aligned longitudinally of and extending through said helmet shell within said outside air path, and a shutter device, said shutter device comprising:

a base to be fitted on the helmet shell of the helmet, the base having a plurality of vent holes configured to coincide with the plurality of through-holes aligned longitudinally of and extending through said helmet shell; and a shutter plate slidably held on the base along a path defined in a path defining body longitudinally extending on an outer surface of the helmet shell and encompassing a fitted portion of the base, so as to adjustably open and close the vent holes of the base and thereby create a negative pressure for achieving ventilation of air within said helmet through said vent holes and into said outside air path, wherein the base comprises a plurality of separate and independent bases each having a vent hole configured to coincide with each of the through-holes.

9. The helmet according to claim 8, wherein one of said vent holes of the base is configured to coincide with a foremost one of the through-holes of the helmet shell and has a peripheral edge formed with an air flow guide raised on a rear side thereof.

10. The helmet according to claim 8, wherein the shutter device further comprises a full open stopper for preventing sliding of the shutter plate once the vent holes of the separate bases have been fully opened by causing the shutter plate to interfere with at least one of the separate bases, and a full closure stopper for preventing sliding of the shutter plate once the vent holes of the separate bases have been fully closed by causing the shutter plate to interfere with at least one of the separate bases.

11. The helmet according to claim 10, wherein one of said vent holes of the base is configured to coincide with a foremost one of the through-holes of the helmet shell and has a peripheral edge formed with an air flow guide raised on a rear side thereof.

12. The helmet according to claim 8, wherein the shutter plate is engaged with the base so to slide thereon and is provided with an operating portion extending rearwardly through the rear air outlet defined by the path defining body, the operating portion formed with a projection abutting an internal top surface of the path defining body for preventing the operating portion from springing upward.

13. The helmet according to claim 9, wherein the shutter plate is engaged with the base so to slide thereon and is provided with an operating portion extending rearwardly through the rear air outlet defined by the path defining body, the operating portion formed with a projection abutting an internal top surface of the path defining body for preventing the operating portion from springing upward.

14. The helmet according to claim 10, wherein the shutter plate is engaged with the base so to slide thereon and is provided with an operating portion extending rearwardly through the rear air outlet defined by the path defining body, the operating portion formed with a projection abutting an internal top surface of the path defining body for preventing the operating portion from springing upward.

15. A helmet with a ventilating function having a helmet shell, a longitudinally extending outside air path having a front inlet and a rear air outlet, a plurality of through holes aligned longitudinally of and extending through said helmet shell within said outside air path, and a shutter device, said shutter device comprising:

a base to be fitted on the helmet shell of the helmet, the base having a plurality of vent holes configured to coincide with the plurality of through-holes aligned longitudinally of and extending through said helmet shell;

a shutter plate slidably held on the base along a path defined in a path defining body longitudinally extending on an outer surface of the helmet shell and encompassing a fitted portion of the base, so as to adjustably open and close the vent holes of the base and thereby create a negative pressure for achieving ventilation of air within said helmet through said vent holes and into said outside air paths wherein the base comprises a plurality of separate and independent bases each having a vent hole configured to coincide with each of the through-holes;

a full open stopper for preventing sliding of the shutter plate once the vent holes of the separate bases have been fully opened by causing the shutter plate to interfere with at least one of the separate bases; and a full closure stopper for preventing sliding of the shutter plate once the vent holes of the separate bases have been fully closed by causing the shutter plate to interfere with at least one of the separate bases.

16. The helmet according to claim 15, wherein one of said vent holes of the base is configured to coincide with a foremost one of the through-holes of the helmet shell and has a peripheral edge formed with an air flow guide raised on a rear side thereof.

17. The helmet according to claim 15, wherein the shutter plate is engaged with the base so to slide thereon and is provided with an operating portion extending rearwardly through the rear air outlet defined by the path defining body, the operating portion formed with a projection abutting an internal top surface of the path defining body for preventing the operating portion from springing upward.

18. The helmet according to claim 16, wherein the shutter plate is engaged with the base so to slide thereon and is provided with an operating portion extending rearwardly through the rear air outlet defined by the path defining body, the operating portion formed with a projection abutting an internal top surface of the path defining body for preventing the operating portion from springing upward.

* * * * *